United States Patent [19]

Feiks et al.

[11] Patent Number: 4,662,031

[45] Date of Patent: May 5, 1987

[54] OPENING ROLLER FOR REMOVING MATERIAL FROM FIBER BALES

[75] Inventors: Stefan Feiks, Monchen-Gladbach; Josef Temburg, Jüchen, both of Fed. Rep. of Germany

[73] Assignee: Trützschler GmbH & Co. KG, Monchen-Gladbach, Fed. Rep. of Germany

[21] Appl. No.: 827,744

[22] Filed: Feb. 10, 1986

[30] Foreign Application Priority Data

Feb. 11, 1985 [DE] Fed. Rep. of Germany ..... 3504615

[51] Int. Cl.[4] ..... D01G 7/04

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,101,513 | 8/1963 | Wildbolz | 19/80 R |
| 4,297,767 | 11/1981 | Leifeld | 19/80 R |
| 4,467,502 | 8/1984 | Lytton et al. | 19/80 R |
| 4,477,944 | 10/1984 | Binder et al. | 19/80 R |
| 4,510,646 | 4/1985 | Locatelli et al. | 19/81 X |

FOREIGN PATENT DOCUMENTS

| | | |
|---|---|---|
| 0013169 | 7/1980 | European Pat. Off. . |
| 3007245 | 9/1981 | Fed. Rep. of Germany . |
| 0104568 | 3/1974 | German Democratic Rep. . |
| 0762345 | 11/1956 | United Kingdom . |
| 2024369 | 1/1980 | United Kingdom . |
| 2073267 | 10/1981 | United Kingdom . |
| 2100766 | 1/1983 | United Kingdom . |
| 2114172 | 8/1983 | United Kingdom . |

*Primary Examiner*—Louis K. Rimrodt

*Attorney, Agent, or Firm*—Spencer & Frank

[57] ABSTRACT

An opening roller for removing tufts from fiber bales includes a cylindrical core adapted to be supported for rapid rotation and annular toothed discs affixed peripherally to the cylindrical core. The toothed discs which have teeth adapted to penetrate into the fiber bales upon rotation of the cylindrical core are arranged to have a helical course.

11 Claims, 7 Drawing Figures

OPENING ROLLER FOR REMOVING MATERIAL FROM FIBER BALES

BACKGROUND OF THE INVENTION

This invention relates to an opening roller for removing material from fiber bales such as cotton bales or chemical fiber bales and is the type which is provided with toothed discs mounted on a cylindrical roller core which is rotated during operation. The teeth project between bars of a hold-down grate and extend into the fiber material.

German Pat. No. 1,131,567 to which corresponds U.S. Pat. No. 3,101,513, discloses an opening roller whose toothed discs are of planar configuration and are arranged at an oblique angle relative to the roller axis whereby, during rotation, each disc wobbles relative to a fixed point externally of the opening roller. By virtue of the oblique positioning of the toothed discs disadvantageous transverse forces are generated between the toothed discs on the one hand and the fiber bale on the other hand. It is also a disadvantage that mounting and securing the obliquely arranged toothed discs on the opening roller involve significant manufacturing expenses.

SUMMARY OF THE INVENTION

It is an object of the invention to provide an improved opening roller of the above-outlined type which is so structured that transverse forces acting on the teeth are, for all practical purposes, eliminated and further, the manufacture of the opening roller is significantly simplified.

These objects and others to become apparent as the specification progresses, are accomplished by the invention, according to which, briefly stated, the toothed discs have a helical course.

By virtue of the helical configuration of each toothed disc transverse forces on the teeth during the removal of fiber material from the bales will not be generated. The teeth of the toothed disc sink in succession into the surface of the bale thus working within a certain band zone as viewed in the width of the bale (that is, as viewed parallel to the roller axis). By virtue of the helical configuration the pressure exerted by the fiber bale on the opening roller is reduced so that the feed of the opening roller towards the surface of the fiber bale may be less, resulting in finer removed tufts. Furthermore, the use of the opening roller according to the invention results in an equalization of the manufacturing process. It is a particular advantage of the invention that the helical toothed discs may be manufactured in a simple manner and may be mounted on the roller core simply and rapidly; this represents a significant manufacturing advantage. Also, by practicing the invention, the overall number of the toothed discs may be reduced.

According to a further feature of the invention the opening roller has toothed discs of left-hand and right-hand helical course. By virtue of this feature an axial pressure or an imbalance may be reduced or eliminated altogether, in case the teeth are not aligned mechanically.

According to a further preferred feature of the invention, the toothed disc has between three to eight teeth. Preferably, the toothed disc has at least one opening slot (discontinuity). The toothed discs may be made in a simple manner by punching from a sheet metal blank, providing an opening slot and then bending into a helical configuration. Preferably, the toothed disc has a free circumferential length portion between two consecutive teeth. In this manner, the weight of the toothed disc is reduced, whereby a significant weight reduction is achieved if a great number of toothed discs are used on the opening roller. Preferably, the toothed disc is made of at least two parts. This makes possible to manufacture and mount the toothed discs on the roller core in segments.

DESCRIPTION OF THE PREFERRED EMBODIMENTS

Figure 1:
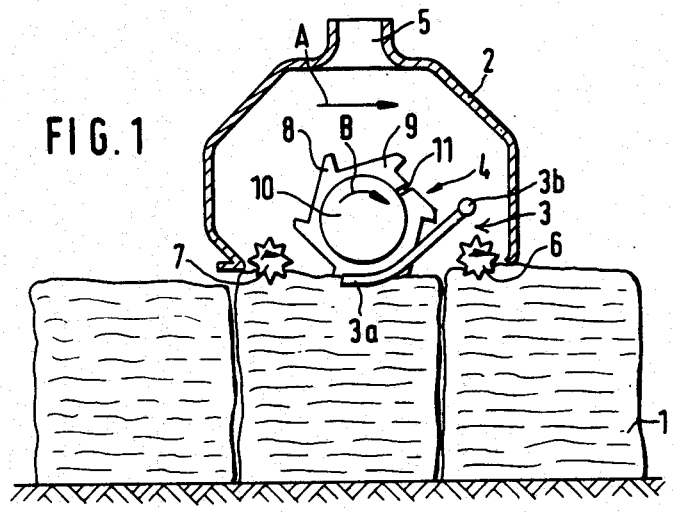
FIG. 1 is a schematic side elevational view of a fiber bale opening device incorporating the invention.

Turning to FIG. 1, there are shown a plurality of stationary fiber bales 1 serially arranged along rails (not shown) on which a carriage (also not shown) of a fiber bale opening device may travel back and forth. On the carriage there is mounted a vertically displaceable opening device which includes a housing 2, a grate 3 formed of a plurality of grate bars 3*a* (only one shown in FIG. 1) secured to the housing at 3*b* for pivotal motion in a vertical plane, an opening roller 4 and a suction duct 5 to withdraw fiber tufts from the housing 2 after they are thrown thereinto from the fiber bales by the opening roller 4. Such a bale opener may be, for example, a "BLENDOMAT BDT" model, manufactured by Trützschler GmbH & Co. KG, Mönchengladbach, Federal Republic of Germany. As shown in FIG. 1, the opening device, during fiber removal from the bales, moves in the direction of the arrow A. The grate 3 is oriented in such a manner that its grate bars 3*a* project between circumferential gaps defined between teeth 9 of the rapidly rotating opening roller 4. The teeth 9 project into the upper surface of the fiber bales 1. The grate 3 serves as a hold-down device with those portions of the grate bars 3*a* which engage the fiber bale. Upstream and downstream of the opening roller 4 there are arranged two axially parallel pressing rollers 6 and 7 which press on the upper face of the fiber bales 1 to ensure that the latter remain stationary and are thus secured against shifting or tipping over.

The opening roller 4 is formed of a cylindrical core 10 to which there are secured, for example, by welding, toothed annular discs 8 whose teeth 9 project between adjoining grate bars 3*a* into the upper face of the fiber bales. The diameter of the cylindrical core 10 may be, for example, 50 to 600 mm. Each toothed annular disc 8 may have, for example, six teeth 9. The opening roller 4 rotates clockwise as indicated by the arrow B. Each toothed annular disc 8 has open ends defining a gap or discontinuity 11. The teeth 9 are oriented in the direction of rotation B.

Figure 2:
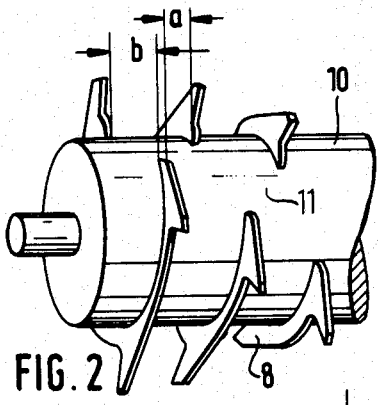
FIG. 2 is a schematic perspective view of a preferred embodiment of the invention.

Turning now to FIG. 2, there is illustrated therein a length portion of the opening roller 4, including a plurality of toothed annular discs 8 mounted on the core 10. Each toothed disc 8 has a helical course and thus the teeth 9 of each toothed disc 8 describe a helical path about the core 10. Adjoining helical toothed discs 8 are at an axial distance a from one another to accommodate respective grate bars 3*a*. The gap 11 defined by the open ends of each toothed disc 8 has an axially measured dimension b. Preferably, $b=x(z-1)-c$, wherein x is the axial distance between two adjoining teeth, for example, 4 to 20 mm, including the thickness of one toothed disc, z is the number of teeth and c is the thickness of the tooth in millimeter. The distance b may be approximately 10 to 80 mm. The distance a between two adjoining toothed discs preferably corresponds to the relationship $a=(b+c)/(z-1)-c$, and equals about 4 to 50 mm.

Figure 3:
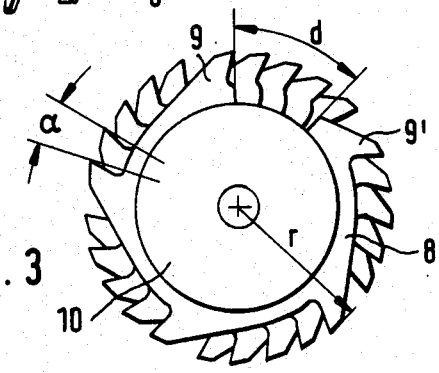
FIG. 3 is an end view of a structure similar to that illustrated in FIG. 2.

Turning now to FIG. 3, there is shown in end view an opening roller wherein each toothed disc 8 has five teeth 9. The angle $\alpha$ between circumferentially consecutive teeth 9 (belonging to axially adjoining consecutive toothed discs 8) corresponds preferably to the relationship $\alpha=282/r0.5$, wherein r is the radius of the toothed disc center to the tooth tip and may be 75 to 350 mm.

Each toothed disc 8 has, between two consecutive teeth 9, 9' a gap 11 whose circumferentially measured dimension is designated at d. Preferably, the teeth of the toothed discs are arranged on the cylindrical roller core in a screw-thread like fashion. This ensures that adjacent teeth extend into the bale surface in succession.

Figure 4:
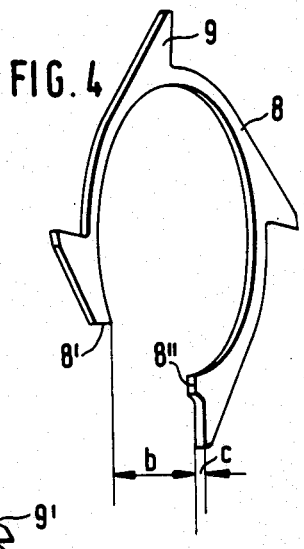
FIG. 4 is a perspective view of a component of the construction shown in FIG. 2.

FIG. 4 illustrates helical toothed disc 8 having four teeth 9. The thickness of the disc 8 is designated at c. The axial offset between the open ends 8', 8'' of the toothed disc 8 is designated at b.

Figure 5A:
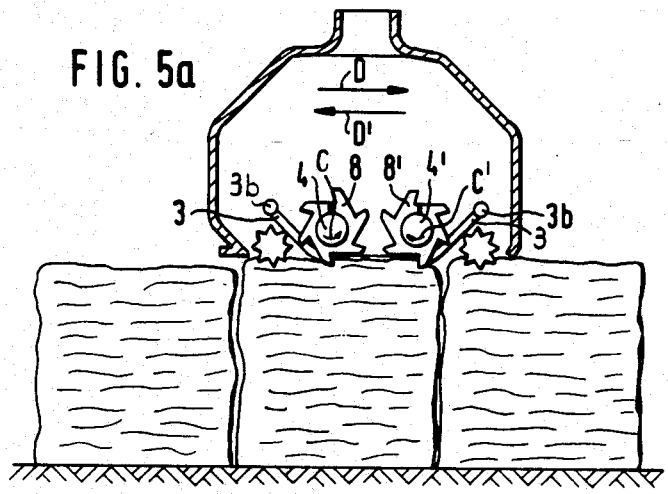
FIG. 5*a* is a schematic side elevational view of another bale opening device incorporating the invention.

FIG. 5*a* illustrates schematically a bale opening device which has two opening rollers 4 and 4'. The arrows C, C' indicate the direction of rotation of the opening rollers 4, 4'. The tips of the teeth 9 are oriented in the direction of rotation. The grate 3 extends underneath the opening rollers 4 and 4' and may pivot about supports 3*b*.

The arrows D and D' indicate successive operating directions in the two directions of motion.

Figure 5B:
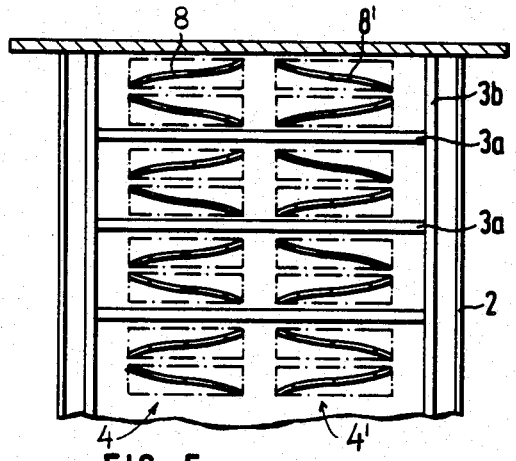
FIG. 5*b* is a schematic top plan view of the construction shown in FIG. 5*a* with cover removed.

FIG. 5*b* schematically shows the two opening rollers 4 and 4' in top view indicating the course of the toothed discs 8 of the opening roller 4 and the toothed discs 8' of the opening roller 4'. The helical course of each toothed disc is effected by bending the discs in an S or Z form. About each toothed disc visible in FIG. 5*b* there is circumscribed a rectangle indicated in dash-dot lines to designate the zone within which the respective discs 8 and 8' engage into the upper surface of the bale upon rotation of the opening rollers 4, 4'. In the zone between two adjoining grate bars 3*a* each opening roller has two toothed discs arranged in opposite orientation, that is, they have a left-hand and, respectively, a right-hand helical course.

Figure 5C:
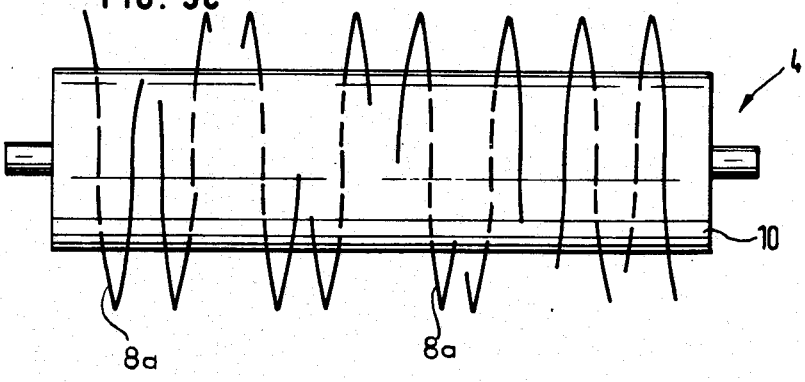
FIG. 5*c* is a schematic, partially diagrammatic view of a second preferred embodiment of the invention incorporated in the construction shown in FIGS. 5*a* and 5*b*.

Turning to FIG. 5*c*, there is illustrated the cylinder core 10 of the opening roller 4 and there are diagrammatically shown the peripheral course lines 8*a* of each toothed disc (not shown). As viewed axially, the toothed discs have alternatingly a left-hand and a right-hand helical course.

It will be understood that the above description of the present invention is susceptible to various modifications, changes and adaptations, and the same are intended to be comprehended within the meaning and range of equivalents of the appended claims.

What is claimed is:

1. In an opening roller for removing tufts from fiber bales, including a cylindrical core having an axis and annular toothed discs affixed in an axially spaced relationship peripherally to said cylindrical core; said toothed discs having teeth adapted to penetrate into the fiber bales upon rotation of said cylindrical core; the improvement wherein each said toothed disc has a helical course, and further wherein axially adjoining teeth are peripherally offset relative to one another and said teeth, viewed as a whole, extend in a screw-thread pattern on said cylindrical core and further comprising a plurality of circumferential annular clearances defined between selected adjoining toothed discs for accommodating grate bars of a grate in an installed state of said opening roller.

2. An opening roller as defined in claim 1, wherein some of said toothed discs have a left-hand helical course and some of said toothed discs have a right-hand helical course.

3. An opening roller as defined in claim 2, wherein said toothed discs have alternatingly a left-hand and a right-hand helical course as viewed along said cylindrical core.

4. An opening roller as defined in claim 1, wherein each said toothed disc has a discontinuity having an axially measured dimension equalling $x(z-1)-c$, wherein x is the distance between two adjoining teeth belonging to a common said toothed disc; z is the number of teeth of said common toothed disc and c is the thickness of the teeth of said common toothed disc.

5. An opening roller as defined in claim 1, wherein each said toothed disc has a discontinuity having an axially measured dimension of approximately 10 to 80 mm.

6. An opening roller as defined in claim 1, wherein an angle formed between two peripherally consecutive teeth belonging to separate, axially adjoining toothed discs equals approximatively $282/r0.5$, wherein r is a radius of the opening roller measured from the axis of the cylindrical core to outer tips of the teeth.

7. An opening roller as defined in claim 1, wherein each said toothed disc has a discontinuity having an axially measured dimension and further wherein axially adjoining toothed discs have an axially measured distance from one another; said distance equalling $(b+c)/(z-1)-c$, wherein b is said axially measured dimension, z is the number of teeth in said axially adjoining toothed discs and c is the thickness of the teeth.

8. An opening roller as defined in claim 1, wherein two axially adjoining said toothed discs have an axially measured distance of approximately 4 to 50 mm.

9. An opening roller as defined in claim 1, wherein said toothed discs each have between three and eight teeth.

10. An opening roller as defined in claim 1, wherein each said toothed disc has a discontinuity having a circumferentially measured dimension.

11. An opening roller as defined in claim 1, wherein at least one of said toothed discs is a multi-part component.

* * * * *